US010376084B2

(12) United States Patent
Hempsch et al.

(10) Patent No.: US 10,376,084 B2
(45) Date of Patent: Aug. 13, 2019

(54) MAILBOX SYSTEM HAVING A REMOVABLE MAILBOX

(71) Applicants: Christoph Hempsch, Bonn (DE); Daniel Meyer, Bonn (DE); Jörg Salomon, Bonn (DE); Farhad Shahed, Köln (DE); Thomas Vogel, Düsseldorf (DE); Achim Kampker, Aachen (DE)

(72) Inventors: Christoph Hempsch, Bonn (DE); Daniel Meyer, Bonn (DE); Jörg Salomon, Bonn (DE); Farhad Shahed, Köln (DE); Thomas Vogel, Düsseldorf (DE); Achim Kampker, Aachen (DE)

(73) Assignee: Deutsche Post AG, Bonn (DE)

( * ) Notice: Subject to any disclaimer, the term of this patent is extended or adjusted under 35 U.S.C. 154(b) by 27 days.

(21) Appl. No.: 14/705,098

(22) Filed: May 6, 2015

(65) Prior Publication Data

US 2015/0320248 A1 Nov. 12, 2015

(30) Foreign Application Priority Data

May 12, 2014 (DE) ..... 10 2014 106 687

(51) Int. Cl.

| | |
|---|---|
| ***A47G 29/12*** | (2006.01) |
| ***A47G 29/14*** | (2006.01) |
| ***A47G 29/20*** | (2006.01) |
| ***A47G 29/30*** | (2006.01) |

(52) U.S. Cl.

CPC ..... *A47G 29/1216* (2013.01); *A47G 29/12* (2013.01); *A47G 29/14* (2013.01); *A47G 29/20* (2013.01); *A47G 29/30* (2013.01); *A47G 2029/144* (2013.01)

(58) Field of Classification Search

CPC .. A47G 29/12; A47G 29/1216; A47G 29/122; A47G 29/124; A47G 29/14; A47G 2029/144; A47G 2029/148; A47G 29/20; A47G 29/30; A47G 29/1207; B65F 1/141; B65F 1/1415

USPC ..... 232/17, 19, 29, 30–32, 39, 44, 45; 248/146; 211/71.01, 85.29

See application file for complete search history.

(56) References Cited

U.S. PATENT DOCUMENTS 378,955 A * 3/1888 Dubey ..... A47G 29/1207 193/8
461,381 A * 10/1891 Richter ..... A47G 29/1207 232/30

(Continued)

FOREIGN PATENT DOCUMENTS

CH 570 143 A5 12/1975
CN 201977205 U 9/2011

(Continued)

*Primary Examiner* — William L Miller
(74) *Attorney, Agent, or Firm* — Reinhart Boerner Van Deuren P.C.

(57) ABSTRACT

Described and shown is a Mailbox system (1) for receiving at least one item of mail. In order to simplify the delivery and/or handing over of items of mail the mailbox system (1) can comprise a mailbox (2) and a mailbox holder (3), wherein the mailbox (2) has an interior for receiving the at least one item of mail and at least one entry (4) to the interior for inserting the at least one item of mail into the interior, and wherein the mailbox (2) is detachably held by the mailbox holder (3).

14 Claims, 4 Drawing Sheets

(56) References Cited

U.S. PATENT DOCUMENTS 908,543 A * 1/1909 Brown ..... A47G 29/121 232/28
1,027,524 A * 5/1912 Cook ..... A47G 29/1207 109/50
1,256,044 A * 2/1918 Schilling ..... A47G 29/1207 232/31
1,451,343 A * 4/1923 Panagopolous .... A47G 29/1207 232/30
1,817,191 A 8/1931 Harmony
2,421,221 A * 5/1947 Rothe ..... B07C 7/04 232/30
2,468,897 A * 5/1949 Rothe ..... B65D 29/00 232/16
3,107,848 A * 10/1963 Penta ..... A47G 29/1209 232/17
3,999,702 A 12/1976 Conroy
4,333,603 A * 6/1982 Carlson ..... A47G 29/1209 232/17
4,363,438 A * 12/1982 Connor ..... A47G 29/1207 232/30
5,169,062 A 12/1992 Baker
5,337,953 A 8/1994 Haest
5,425,501 A * 6/1995 Wesorick ..... A47G 29/1209 232/17
5,586,718 A * 12/1996 Speece ..... A47G 29/1209 232/17
5,915,618 A * 6/1999 Gaudet ..... A47G 29/1209 232/17
6,123,257 A * 9/2000 Guidicy ..... A47G 29/1216 232/17
6,234,387 B1 * 5/2001 Cuthbert ..... A47G 29/1209 232/17
6,808,108 B1 * 10/2004 Turnbow ..... A47G 29/1209 232/17
6,923,367 B1 8/2005 Grossman et al.
6,997,373 B2 * 2/2006 Flores ..... A47G 29/1209 232/17
7,487,907 B2 * 2/2009 Miller ..... A47G 29/1201 232/24
7,611,043 B2 * 11/2009 Black ..... A47G 29/1216 232/38
8,042,729 B2 * 10/2011 Dinh ..... A47G 29/1209 232/17
8,757,476 B2 * 6/2014 Childress ..... A47G 29/1209 232/17
8,875,987 B2 * 11/2014 Supulski ..... A47G 29/1209 232/17
2003/0154891 A1 8/2003 Fassbender et al.
2004/0238615 A1 * 12/2004 Offenbacher ..... A47G 29/1209 232/29
2005/0247772 A1 * 11/2005 Miller ..... A47G 29/12 232/45
2008/0314967 A1 12/2008 Black

FOREIGN PATENT DOCUMENTS

CN 202055598 U 11/2011
CN 202457748 U 10/2012
CN 203142841 U 8/2013
DE 16 79 047 A1 2/1972
DE 198 24 647 A1 12/1999
GB 2 372 291 A 8/2002
GB 2 499 598 A 8/2013
WO WO 03/050005 A2 6/2003

* cited by examiner

MAILBOX SYSTEM HAVING A REMOVABLE MAILBOX

CROSS-REFERENCE TO RELATED PATENT APPLICATIONS

This patent application claims priority to German Application No. 10 2014 106 687.1, filed May 12, 2014, the entire teachings and disclosure of which are incorporated herein by reference thereto.

FIELD OF THE INVENTION

This invention relates to a mailbox system for receiving at least one item of mail, to a use of such a mailbox system and to a method for inserting at least one item of mail into the interior of a mailbox and/or for removing at least one item of mail from the interior of a mailbox of a corresponding mailbox system.

BACKGROUND OF THE INVENTION

Letters are normally delivered by a mail carrier depositing the letters to be delivered into the mailboxes of the recipients of the letters. If the mail, however, in addition to at least one letter or instead of a letter comprises at least one parcel or another item, then the corresponding items of mail cannot be delivered in the way described for letters because the mailboxes are not suitable for receiving parcels and/or larger items. Parcels are usually handed over by the mail carrier to the recipient or a neighbour. It is also possible to deposit the parcels at a parcel pick-up station and inform the recipient about this. The recipient of the mail is also given an access code, by means of which the recipient can collect the mail at the parcel pick-up station also known as 'Packstation' (automated booth for self-service collection of parcels and oversize letters). If the above mentioned means are not possible, the mail is stored in a branch mail office until the mail is collected by the recipient or sent back to the sender.

The delivery of items of mail which comprise at least one package which cannot be delivered in normal mailboxes and/or at least one parcel and/or the delivery of items of mail which have at least one other item consequently involves time and effort to a greater or lesser extent. Therefore, there is a need for optimisation with regard to the delivery of such items of mail.

SUMMARY OF THE INVENTION

The present invention is therefore based on the object of enhancing and further developing the mailbox, the use and the method of the kind mentioned in the introduction in each case such that the delivery and/or handing over of items of mail can be simplified.

This object is achieved with a mailbox system according to the teachings herein by providing a mailbox and a mailbox holder, by the mailbox having an interior for receiving the at least one item of mail and at least one entry to the interior for inserting the at least one item of mail into the interior and by the mailbox being detachably held by the mailbox holder.

Hence, the invention is based on the basic idea of providing a mailbox which is detachable on a mailbox holder, wherein the function of the mailbox is to receive the mail. For this purpose, the mailbox has at least one entry to an interior of the mailbox, so that one or more items of mail can be inserted into the interior of the mailbox, where the item of mail can then be kept ready for collection. Although this involves increased time and effort compared to known letter boxes, in this way the delivery, and where necessary the handing over, of items of mail can be considerably simplified or, at any rate, can be made more flexible. The mailbox can namely be separated from the mailbox holder in order to effect the delivery. With the appropriate supporting means, for instance appropriate vehicles, this can optionally be effected partly automatically or even fully automatically. Ultimately, the mailbox system enables new and improved methods to be used for delivering items of mail. It is therefore not necessary for the mailbox to be manually taken from the mailbox holder for the purpose of delivering items of mail. In addition, the mailbox can be easily dimensioned in such a way that the mailbox can also receive larger items of mail. Therefore, personally handing over items of mail or depositing items of mail at a place which is far away from the recipient can be dispensed with.

Besides that, the mailbox system allows items of mail to be deposited in the mailbox by a sender. The at least one item of mail can then be collected from the mailbox and sent or delivered to the addressee. If desired, the same entry to the interior of the mailbox can be used for depositing as is used for inserting at least one item of mail into the mailbox of the recipient of the mail. The mailbox system thereby enables a flexible and efficient handling of mail to take place.

The mailbox system can be used in equal measure for different items of mail. These are preferably letter deliveries, parcel deliveries and/or flyers. A flyer can, for example, also be a brochure, a magazine or a leaflet, while a parcel delivery, for example, can be a package or a parcel. Apart from that, letter deliveries can, for example, be both letters and postcards. Each letter and each postcard is a letter delivery and each package and each parcel is a parcel delivery. However, other deliveries, which can be items for instance in the form of packaged goods, are also possible. A delivery can, for example, be an item which is a basic necessity, for instance a consumable material, a hygiene product and/or a food product.

In order to be able to ensure this flexibility, the entry in at least two spatial directions perpendicular to one another, i.e. in width and height for instance, respectively has a dimension of at least 10 cm, preferably at least 20 cm, in particular at least 30 cm. Alternatively or additionally, the interior can be dimensioned in three spatial directions perpendicular to one another, i.e. in width, height and depth for instance, respectively at least 10 cm, preferably at least 20 cm, in particular at least 30 cm in size, in order to be able to receive correspondingly large items of a delivery. If the mailbox is to receive a plurality of deliveries of items of different sizes, then it can be advantageous if the interior of the mailbox is partitioned. The interior can, for example, have at least one smaller compartment for smaller items and at least one larger compartment for larger items.

In the present case, in particular delivering, a delivery and a deliverer are referred to. In particular in the case of a letter delivery, a parcel delivery and/or a flyer, alternatively mail carrying, mail delivery and/or a mail carrier can also be referred to, for example as a special form of delivering, delivery and/or deliverer. A strict separation between the terms is, however, not necessary, as the meaning is derived by the person skilled in the art from the context in each case.

In a first preferred mailbox system, the mailbox is held by the mailbox holder at least in the direction of the force of gravity in a form-fit and/or force-fit manner. The mailbox in this way can be held in a simple and secure manner by the mailbox holder. Alternatively or additionally, provision can be made for the mailbox to be suspended in and/or inserted into the mailbox holder. In this way, it is easy to separate the mailbox from the mailbox holder and subsequently connect it again. The mailbox can be easily detached from the suspended position and/or pulled out, so that it can subsequently be suspended in and/or inserted into the mailbox holder again. A connection between the mailbox and the mailbox holder can, for example, be understood as suspending and/or inserting. If required, a form-fit in the direction of the force of gravity thus suffices for the connection between the mailbox and the mailbox holder. However, at least one form-fit and/or force-fit in a horizontal plane, i.e. perpendicular to the direction of the force of gravity, can also be provided. The at least one corresponding connection can then, for example, prevent the mailbox from being pulled out in relation to the mailbox holder.

In order to be able to keep the mailbox secure and, if required, protect it better against outside influences, the mailbox holder can have two side walls and a roof element connecting the side walls. For simplicity, the side walls are then formed parallel to one another and, as the case may be, perpendicular to the roof element. Ultimately, a U-shaped mailbox holder may be the result, the legs of which point downwards and not upwards like a U. The mailbox holder can therefore have an inverted U-shape.

Particularly with such a shape of the mailbox holder and/or of a mailbox holder partly surrounding the mailbox, the mailbox on opposing outer sides and the mail box holder on opposing inner sides each can have corresponding holding units, wherein the holding unit of the mailbox holder grips under the holding units of the mailbox. This makes a structurally simple design of the mailbox system possible and in addition to that makes it easy to handle. At the same time, the opposing inner sides of the mailbox holder are preferably inner sides of the side walls. Then, the mailbox is at least partly securely accommodated in the mailbox holder.

A structurally simple and, at the same time, functional design of the mailbox can be obtained if the holding units of the mailbox are shaped in the form of a pin. The holding units in the form of pins can also serve to remove the mailbox easily and to connect the mailbox and the mailbox holder again easily. Alternatively or additionally, in this context a structurally simple and functional design of the mailbox holder can be obtained if the holding units of the mailbox holder are rail-like in shape.

In order that the holding units can be used for removing the mailbox from the mailbox holder, it is appropriate if the holding units of the mailbox holder are in each case spaced at least 1 cm, at least 2.5 cm or at least 5 cm apart from the adjacent outer sides of the mailbox. The holding devices of the mailbox in the area between the holding units of the mailbox holder and the outer sides of the mailbox can then be gripped by a gripper unit which separates the mailbox from the mailbox holder and subsequently connects it to the mailbox holder again.

In order that the handling of the mailbox can be improved, in particular when it has been separated from the mailbox holder, the holding units of the mailbox between the corresponding holding units of the mailbox holder and the outer sides of the mailbox can at least in sections have a circular cross-section. Then, the mailbox separated from the mailbox holder can, for example, be lightly turned, in order, for example, to tip out an item of mail held available in the mailbox. Alternatively or additionally, the holding units of the mailbox in the area of the holding units of the mailbox holder can have an evenly formed lower area. The holding units can in this way be securely and stably deposited on the holding units.

In order that the mailbox is not by mistake pulled out of the mailbox holder and/or lifted up with respect to the mailbox holder, the mailbox can be secured in a form-fit manner against it being taken out and/or pulled out. It is appropriate for the mailbox to be locked to the mailbox holder by means of a locking device which is to be locked and/or unlocked mechanically, electrically and/or magnetically, so that unauthorised persons also cannot remove the mailbox.

In order to protect an item of mail in the interior of the mailbox from outside influences, the mailbox can have at least one closure element, in particular in the form of a flap, a slide or a door, wherein the closure element can be moved from a position closing off the at least one entry to the interior into a position unblocking the at least one entry to the interior and back again. For simplicity, the entry can be an opening of the mailbox. In order to also prevent unauthorised access to the interior of the mailbox, the closure element can be locked in the position closing off the interior by means of a locking device. The locking device can be allocated to the mailbox and/or to the closure element. In order that the locking device can be simply and reliably operated, it is appropriate if the locking device can be locked and/or unlocked mechanically, electrically and/or magnetically.

In view of the fact that the interior of the mailbox, as the circumstances require, has to both be opened when an item of mail is delivered and by the owner of the mailbox and/or of the item of mail, it can be practical if at least two entries are provided to the interior of the mailbox. An entry can then, for example, be used by the owner of the mailbox and/or of the item of mail, while a deliverer and/or a mail carrier uses the other entry for delivering and/or for collecting an item of mail. However, in order to be able to lock the interior of the mailbox externally, at least one closure element, in particular in the form of a flap, a slide or a door, can be allocated to each entry. The respective closure element can be moved from a position closing off the corresponding entry to the interior into a position unblocking the corresponding entry to the interior and back again. The entry is then, according to the position of the closure element, either usable or blocked. In order to prevent an unauthorised access to the interior of the mailbox, the closure element can also be locked to the mailbox in the position closing off the interior by means of a locking device which is to be locked and/or unlocked mechanically, electrically and/or magnetically.

It is particularly practical for the delivery of the item of mail if the mailbox system is situated on a property where the recipient of the item of mail lives, for instance. It is particularly practical if the mailbox system is situated at most 5 m, preferably at most 2.5 m, in particular at most 1 m, from a property boundary bordering on a street. Then, an item of mail can be inserted into the mailbox or removed from the mailbox from the street. The deliverer or mail carrier does not therefore have to walk up to the recipient's or sender's house, which particularly in rural areas results in considerable savings in distance and time. In addition, in this way, an at least partly automated delivery of items of mail is encouraged.

The object mentioned in the introduction is also achieved by the use of a mailbox system according to the teachings herein for inserting and/or removing an item of mail.

Therefore, the previously described mailbox system can be used in a simple and practical manner for delivering items of mail and/or for collecting items of mail which are to be dispatched, for instance by a mail carrier. Basically, the previously specified advantages of the preferred embodiments of the mailbox system can be utilised.

The object mentioned in the introduction is also achieved by a method for inserting an item of mail into the interior of a mailbox and/or for removing an item of mail from the interior of a mailbox, in which preferably a mailbox system according to the teachings herein is used, in which the mailbox is separated from the mailbox holder, in which an item of mail is inserted into the interior of the mailbox which is separated from the mailbox holder and/or an item of mail is removed from the interior of the mailbox which is separated from the mailbox holder, and in which the mailbox, after the item of mail has been placed into and/or removed from it, is connected to the mailbox holder again.

Thus, the method is based on the basic idea that an item of mail is not inserted into the mailbox and/or removed from the mailbox in situ, but rather the mailbox is firstly removed from the mailbox holder. The delivery and collection of items of mail can in this way be even more highly standardised, which results in savings in costs and time. In addition, the possibility of an at least partly automated delivery and/or collection of items of mail is provided by this method. After the item of mail has been inserted into the interior of the mailbox which is separated from the mailbox holder and/or after the item of mail has been removed from the interior of the mailbox which is separated from the mailbox holder, the mailbox is connected to the mailbox holder again.

In order that the mailbox does not have to be removed from the mailbox holder by a deliverer and brought back to the mailbox holder, which requires increased effort and hence represents an increased burden for the deliverer, at least one holding unit between an outer side of the mailbox and a holding unit of the mailbox holder can be gripped by a gripper, possibly in the form of a gripper arm, and then separated from the mailbox holder by the gripper. An at least partly automated delivery of items of mail and/or collection of items of mail which are already placed in the mailbox is thereby also possible in a simple way.

In order to prevent exposure of the items of mail in the mailbox to outside influences and/or in order to prevent an unauthorised access to items of mail in the mailbox, with respect to the method provision can be made for the mailbox to be opened before, during or after separation from the mailbox holder. The item of mail can then be inserted into the interior of the mailbox. So that the mailbox does not remain open, the mailbox is closed again before, during or after connection of the mailbox to the mailbox holder.

BRIEF DESCRIPTION OF THE DRAWINGS

The invention is explained in more detail below with the aid of the figures illustrating just one exemplary embodiment.

DETAILED DESCRIPTION OF THE INVENTION

Figure 1:
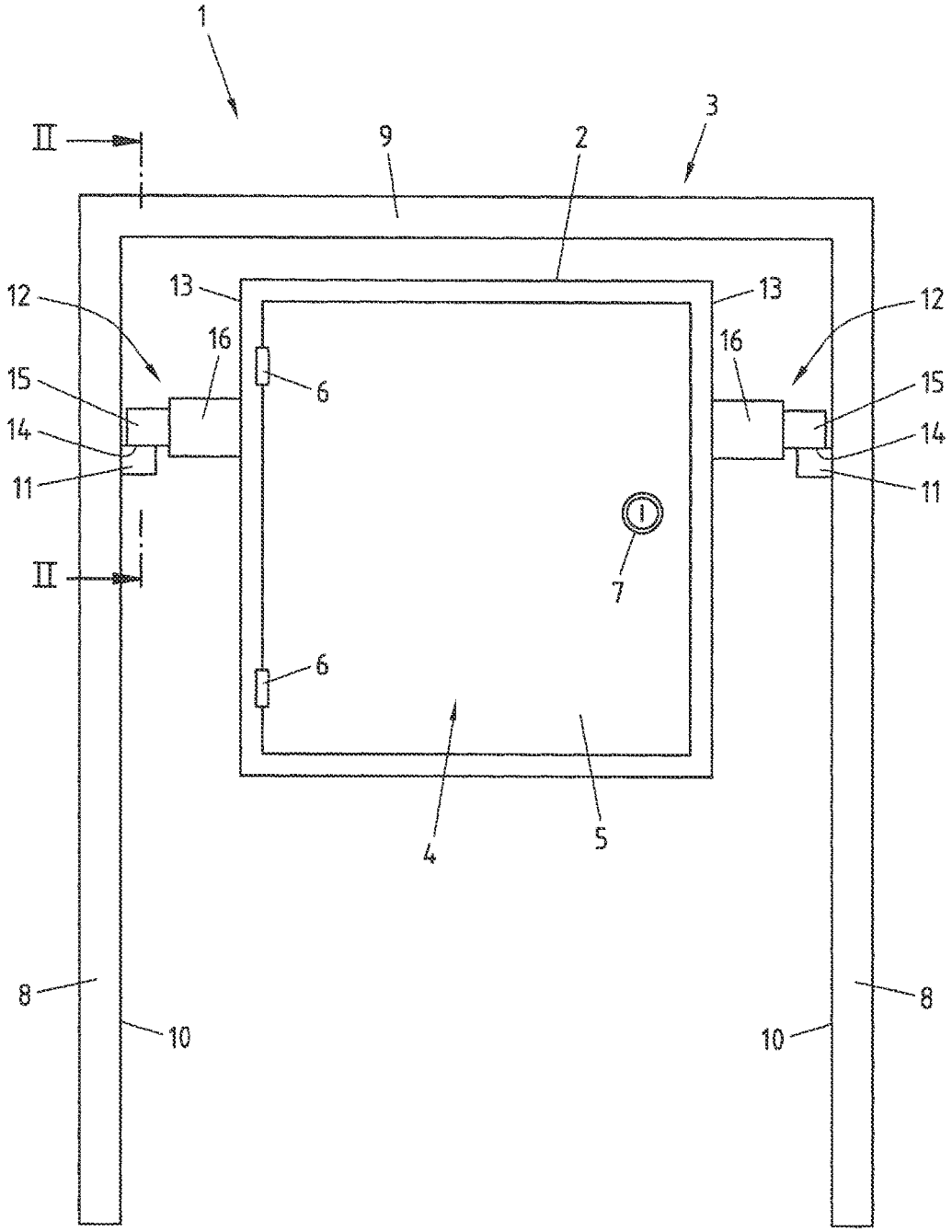
FIG. 1 shows a mailbox system according to the invention in a plan view from the front.
Figure 2:
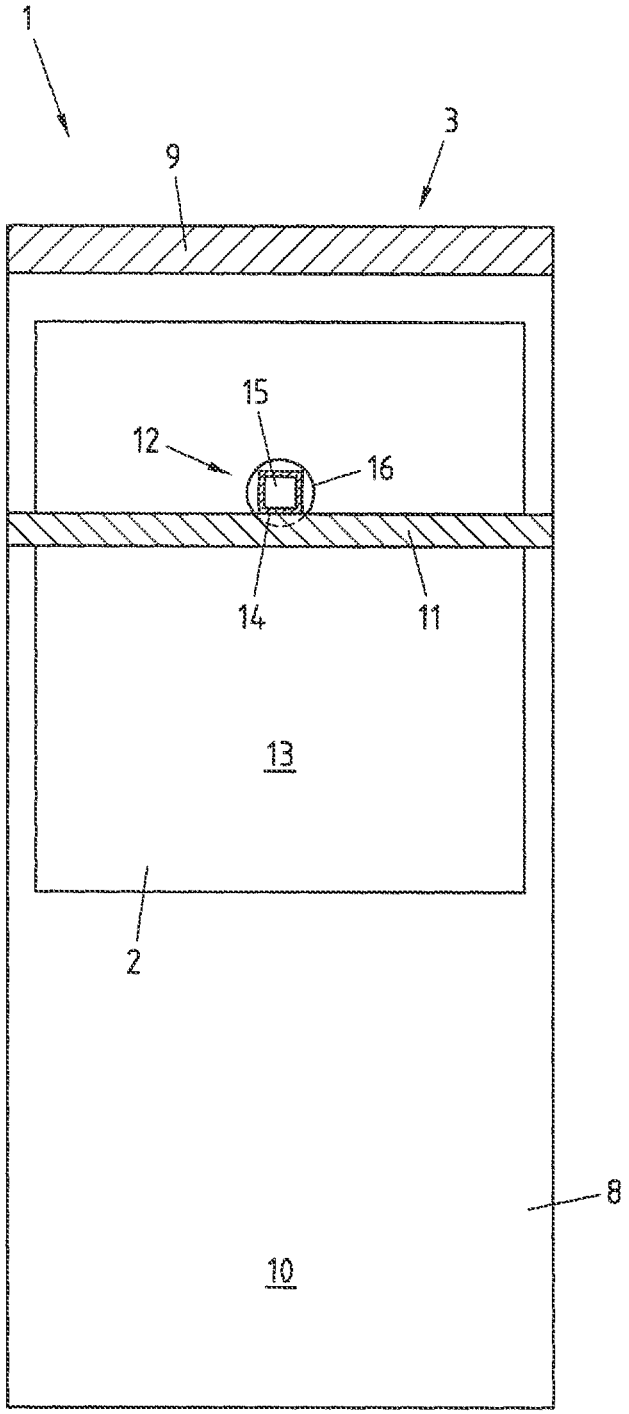
FIG. 2 shows the mailbox system from FIG. 1 in a lateral sectional view along the plane II-II from FIG. 1.

A mailbox system 1 comprising a mailbox 2 and a mailbox holder 3 is illustrated in FIGS. 1 and 2. The mailbox 2 serves for receiving at least one item of mail, in particular a letter, a parcel and/or a flyer, for which purpose the mailbox 2 has an interior and an entry 4 to the interior. The entry 4 to the interior in the illustrated and, in this respect, preferred mailbox 2 is designed as an opening which can be closed by means of a closure element 5 in the form of a door connected to the mailbox 2 via hinges 6. Entry to the interior of the mailbox 2 by unauthorised persons is prevented by a locking device 7, by means of which the closure element 5 can be locked on the mailbox 2.

The mailbox 2 in the illustrated and, in this respect, preferred mailbox system 1 is suspended in a mailbox holder 3. The mailbox holder 3 on opposing sides of the mailbox 2 has two side walls 8 which support a roof element 9 arranged over the mailbox 2. Hence, the mailbox holder 3 is U-shaped, wherein, however, the U is inverted. The mailbox holder 3 has rail-like, in particular horizontally running, holding units 11 on the inner sides 10 of the side walls 8, these holding units 11 cooperating with pin-shaped holding units 12 of the mailbox 2 to keep the mailbox 2 in the mailbox holder 3. The holding units 12 of the mailbox 2 are provided on opposing outer sides 13. The holding units 12 of the mailbox have a lower even surface 14, by means of which the holding units 12 rest stably on the holding units 11 of the mailbox holder 3 and thus largely prevent the mailbox 2 from wobbling in the mailbox holder 3. For simplicity, the areas 15 of the holding units 12 of the mailbox 2 cooperating with the holding units 11 of the mailbox holder 3 are formed as rectangular profiles, in particular as quadratic square profiles. The configuration of the holding units 12 of the mailbox 2 also enables the mailbox 2 to be slid into the mailbox holder 3.

Between the holding units 11 of the mailbox holder 3 and the outer sides 13 of the mailbox 2, the pin-shaped holding units 12 of the mailbox 2 have an area 16 which with the illustrated mailbox system, for example, in each case can be 5 cm wide and has a circular cross-section. This allows the mailbox 2 to be gripped by means of a gripper and lifted and/or pulled out of the mailbox holder 3. In addition, the circular cross-section makes it easier to turn the mailbox 2 when it has been taken out of the mailbox holder 3.

A locking device, by means of which the mailbox 2 is secured against it being pulled out and/or lifted out of the mailbox holder 3 unintentionally, is not illustrated. The mailbox 2 can be locked to the mailbox holder 3 by means of the locking device. The locking mechanism can also be released mechanically, electrically or magnetically.

What is also not illustrated is that the illustrated and, in this respect, preferred mailbox 2 has another entry to the interior in the form of an opening on the top side. A closure element in the form of a slide is allocated to the entry on the top side of the mailbox 2. The closure element can be slid back and forth between a position closing off the entry and a position unblocking the entry. If desired, a corresponding closure element could also be dispensed with. In the case of the illustrated and, in this respect, preferred mailbox 2, no locking device is allocated to the closure element on the top side of the mailbox 2. When the mailbox 2 is accommodated in the mailbox holder 3 and locked to the mailbox holder 3, the entry to the interior on the top side of the mailbox 2 is in any case covered by the roof element 9 of the mailbox holder 3, so that access to the interior of the mailbox 2 is prevented. However, when the mailbox 2 has been separated from the mailbox holder 3, the closure element can easily be slid open without first having to unlock the closure element. A locking device for locking the closure element to the mailbox 2 is unnecessary due to the fact that the mailbox 2 is locked to the mailbox holder 3. Consequently, an item of mail can be placed into the mailbox 2 or an item of mail can be removed from the mailbox 2 without any problems. It is also not necessary for the closure element 5 in the form of a door at the front of the mailbox 2 to be opened. The corresponding key for this can therefore be reserved exclusively for the user of the mailbox 2, which provides security against an unauthorised access to the mailbox 2.

Figure 3:
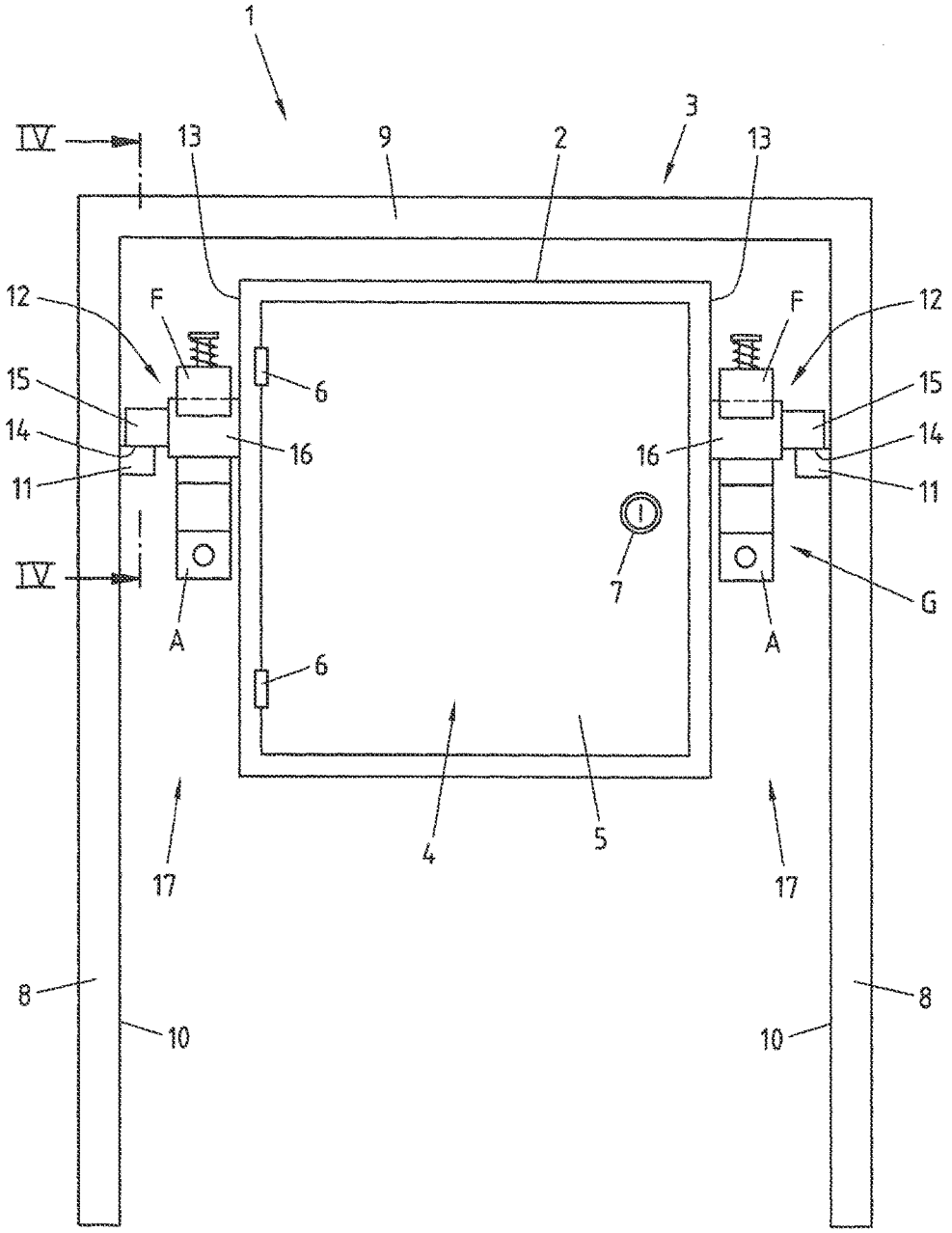
FIG. 3 shows a method step of the method according to the invention on the basis of the mailbox system from FIG. 1 in a plan view of the mailbox system from the front.
Figure 4:
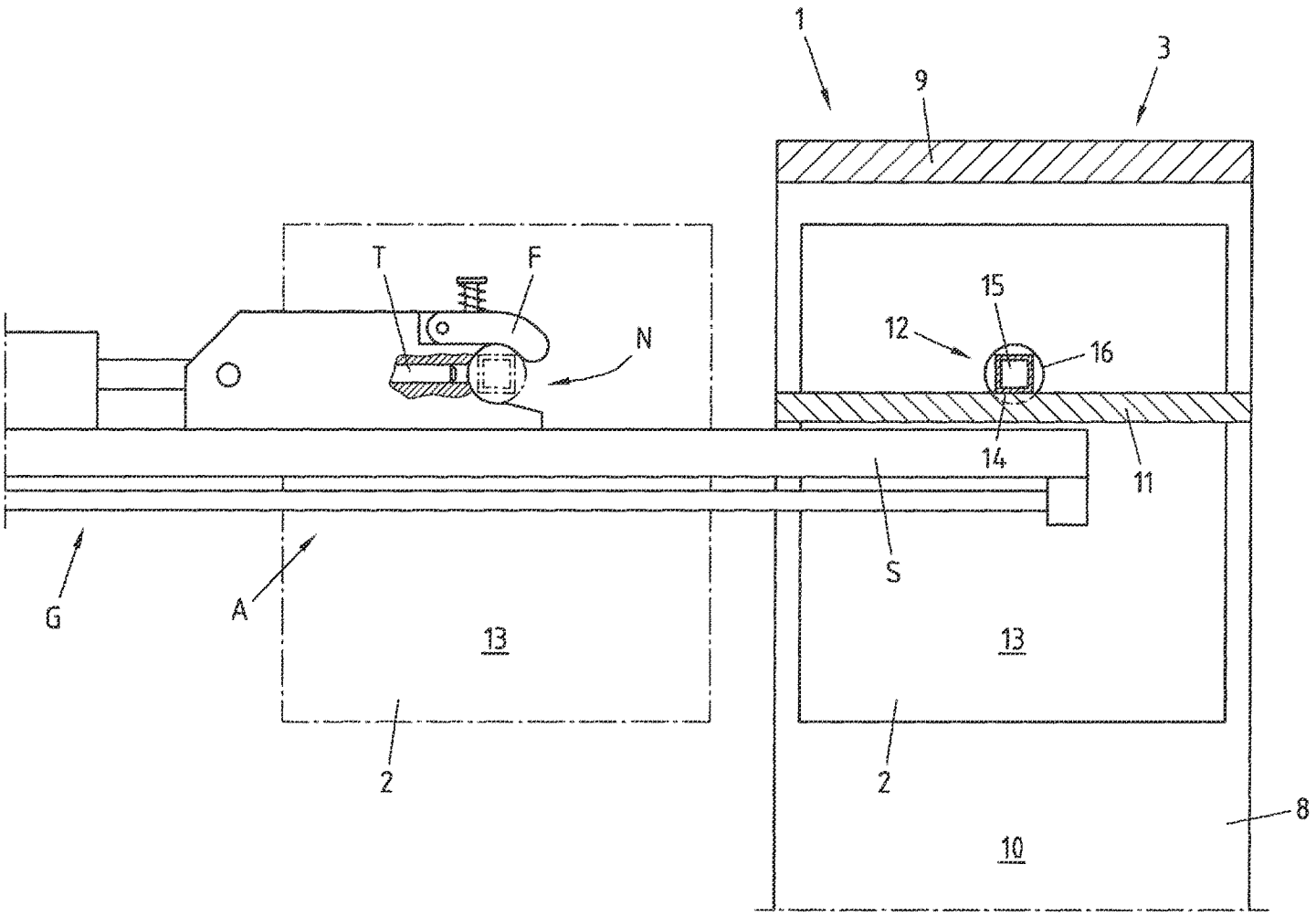
FIG. 4 shows the method step from FIG. 1 in a lateral sectional view along the plane IV-IV from FIG. 3.

By way of example, FIGS. 3 and 4 illustrate the mailbox 2 being taken out of the mailbox holder 3. A gripper G, which has two essentially parallel arms A for this purpose, is moved into the gap between the outer side 13 of the mailbox 2 and the inner side 10 of the side walls 8 of the mailbox holder 3. The gripper G is moved so far into the gap 17 until the gripper G grips the holding unit 12 of the mailbox 2 shaped like a pin with its front end or until the holding unit 12 engages with a receiving holder N. For this purpose, spring-loaded fingers F are provided on the front ends of the arms A of the gripper G and these spring-loaded fingers F can be displaced in order to insert the holding unit 12 of the mailbox 2 into the receiving holders N of the gripper G. The mailbox 2 can now be pulled out of the mailbox holder 3. The mailbox 2 is supported by a telescopic bar S. A turning device can now act upon the parts of the holding units 12 of the mailbox 2 shaped like a pin which are protruding outwards in respect to the receiving holders N and the turning device can turn the mailbox 2 held by the gripper G, so that an item of mail in the mailbox 2 is tipped out through an upper entry in the form of an opening.

The mailbox 2 is connected to the mailbox holder 3 again in essentially the same way as it was removed from the mailbox holder 3 only in the reverse direction. In addition, separating means T, in the form of tappets, which are allocated to the receiving holders N are used when the mailbox 2 is connected to the mailbox holder 3, in which the mailbox 2 can be simply inserted or suspended. The separating means T are moved out, in order to press the holding units 12 of the mailbox 2 against the fingers F holding the holding units 12 and out of the receiving holders N of the gripper G. The mailbox 2 then rests with its holding units 12, which are now disengaged from the receiving holders N, on the holding units 11 of the mailbox holder 3. The gripper G can then be withdrawn without the mailbox 2 from the gaps 17 between the mailbox 2 and the mailbox holder 3.

The invention claimed is:

1. A mailbox system for receiving at least one item of mail, comprising a mailbox and a mailbox holder, wherein the mailbox has an interior for receiving the at least one item of mail and at least one entry to the interior for inserting the at least one item of mail into the interior, and wherein the mailbox is detachably held by the mailbox holder thereby allowing separation therefrom, wherein the mailbox has at least one closure element, wherein the at least one closure element can be moved from a position closing off the at least one entry to the interior into a position unblocking the at least one entry to the interior and back again while the mailbox is detachably held by the mailbox holder, wherein the at least one closure element is accessible from outside the mailbox holder and is provided at a front side of the mailbox while the mailbox is detachably held by the mailbox holder, wherein the mailbox on opposing outer sides and the mail box holder on opposing inner sides of side walls each have corresponding holding units, wherein the holding units of the mailbox holder grip under the holding units of the mailbox, wherein the holding units of the mailbox are shaped in the form of a pin and/or the holding units of the mailbox holder are shaped to the form of a rail, and wherein the free ends of the holding units of the mailbox are in each case spaced at least 2.5 cm apart from the adjacent outer sides of the mailbox.

2. The mailbox system according to claim 1, wherein the holding units of the mailbox are held by the holding units of the mailbox holder at least in the direction of the force of gravity in a form-fit and/or force-fit manner, and/or in that the mail box is suspended in and/or inserted into the mailbox holder.

3. The mailbox system according to claim 1, wherein the mailbox holder has two parallel side walls and a roof element connecting the side walls.

4. The mailbox system according to claim 1, wherein the holding units of the mailbox between the corresponding holding devices of the mailbox holder and the outer sides of the mailbox at least in sections have a circular cross-section, and/or in that the holding units of the mailbox in the area of the holding devices of the mailbox holder have an evenly formed lower area.

5. The mailbox system according to any claim 1, wherein the at least one closure element is in the form of a flap, a slide and/or a door, and the at least one closure element can be locked in the position closing off the interior by means of a locking device which is to be locked and/or unlocked mechanically, electrically and/or magnetically.

6. The mailbox system according to claim 1, wherein the mailbox system is situated on a property and at most 5 m from a property boundary bordering on a street.

7. Use of the mailbox system according to claim 1, for inserting and/or removing the at least one item of mail.

8. A method for inserting the at least one item of mail into the interior of the mailbox and/or for removing the at least one item of mail from the interior of the mailbox of the mailbox system according to claim 1, in which the mailbox is separated from the mailbox holder, in which the at least one item of mail is inserted into the interior of the mailbox which is separated from the mailbox holder and/or the at least one item of mail is removed from the interior of the mailbox which is separated from the mailbox holder, and in which the mailbox, after the at least one item of mail has been placed into and/or removed from it, is connected to the mailbox holder again.

9. The method according to claim 8, in which at least one of the holding units between an outer side of the mailbox and the respective holding unit of the mailbox holder is gripped by a gripper, and in which the mailbox is subsequently separated by the gripper from the mailbox holder.

10. The method according to claim 8, in which the mailbox is opened before, during or after separation from the mailbox holder and/or is closed before, during or after connection to the mailbox holder.

11. The mailbox system according to claim 1, wherein the mailbox system is situated on a property and at most 2.5 m from a property boundary bordering on a street.

12. The mailbox system according to claim 1, wherein the mailbox system is situated on a property and at most 1 m from a property boundary bordering on a street.

13. The mailbox system according to claim 1, wherein the free ends of the holding units of the mailbox are in each case spaced at least 5 cm apart from the adjacent outer sides of the mailbox.

14. The mailbox system according to claim 1, wherein the holding units of the mailbox holder run horizontally on the opposing inner sides of the sidewalls of the mailbox holder.

* * * * *